United States Patent [19]

Watrous, Jr.

[11] Patent Number: 4,958,868

[45] Date of Patent: Sep. 25, 1990

[54] DOOR BAR

[76] Inventor: Mitchell L. Watrous, Jr., 1032 Highland Park Drive, Somerset, Pa. 15501

[21] Appl. No.: 440,708

[22] Filed: Nov. 24, 1989

[51] Int. Cl.[5] ..... E05C 19/18

[52] U.S. Cl. ..... 292/291; 292/258

[58] Field of Search ..... 292/291, 292, 293, 294, 292/295, 296, 258

[56] References Cited

U.S. PATENT DOCUMENTS

| | | | |
|---|---|---|---|
| 359,815 | 3/1887 | Sargent | 292/291 |
| 1,446,364 | 2/1923 | Wheeler . | |
| 1,971,440 | 8/1934 | Aubertin | 292/292 |
| 2,160,460 | 5/1939 | McNaney | 292/291 |
| 2,665,935 | 1/1954 | Patterson | 292/292 |
| 3,039,806 | 6/1962 | Rice | 292/293 |
| 3,352,587 | 11/1967 | Harvey | 292/289 |
| 3,494,653 | 2/1970 | Steele | 292/291 |
| 4,099,754 | 7/1978 | Hoebing | 292/206 |
| 4,386,797 | 6/1983 | Duran Sr. | 292/292 |

*Primary Examiner*—Richard E. Moore

*Attorney, Agent, or Firm*—Donald A. Kettlestrings

[57] ABSTRACT

A door bar for use in combination with a door and a door frame for maintaining the door in a closed position with respect to the frame includes a plate member which is attached to the door frame and a bar member defining a slot therein. The plate member defines a first planar element and a second planar element at a right angle to the first planar element, and the bar member is positioned, by use of the slot, over the plate member and between the door-door frame and the second element whereby the door is retained in a closed position by means of the bar member.

7 Claims, 3 Drawing Sheets

Fig. 3.
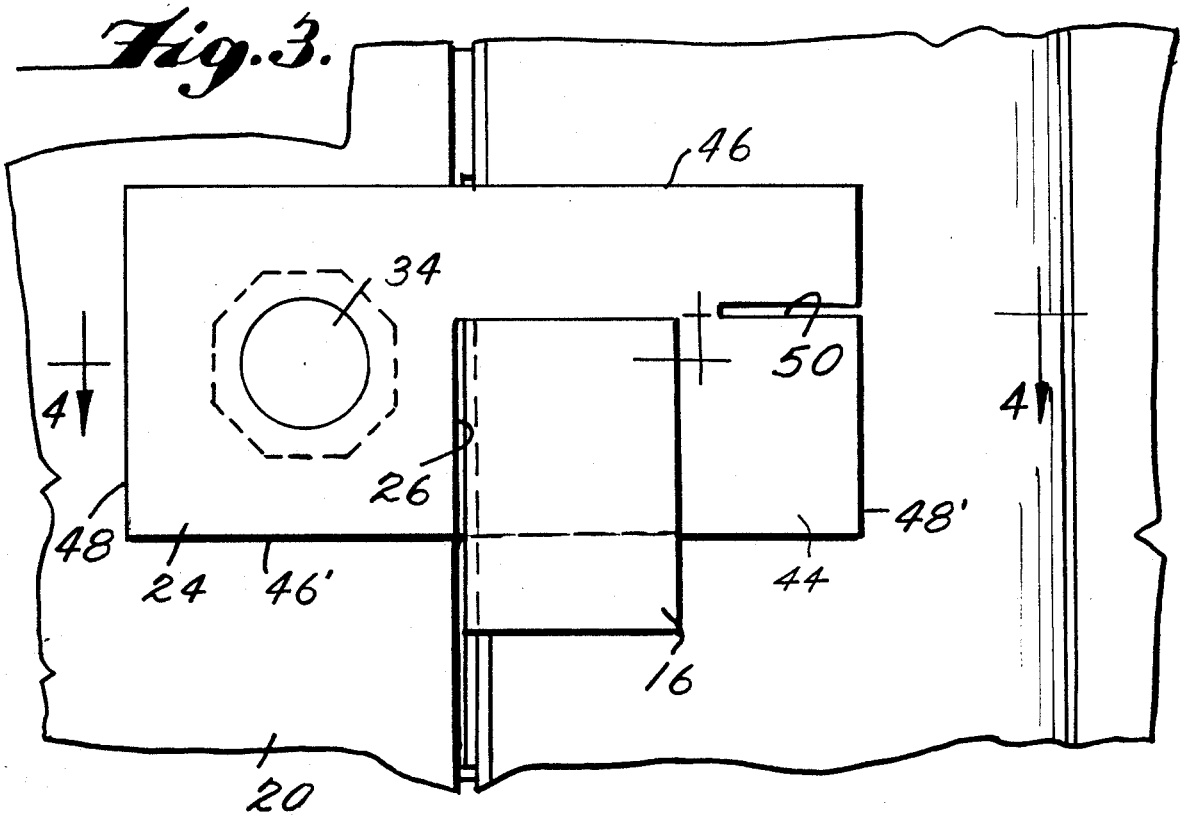
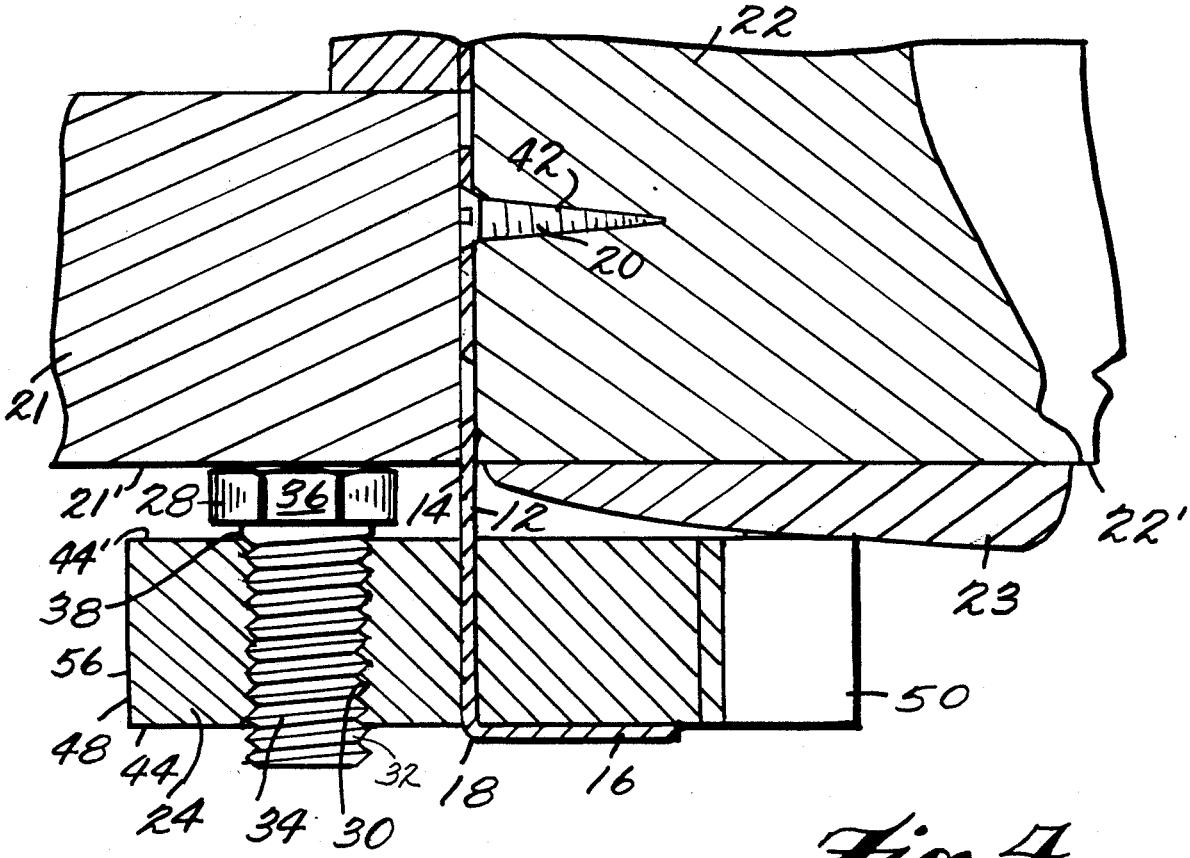
Fig. 4.

Fig. 5
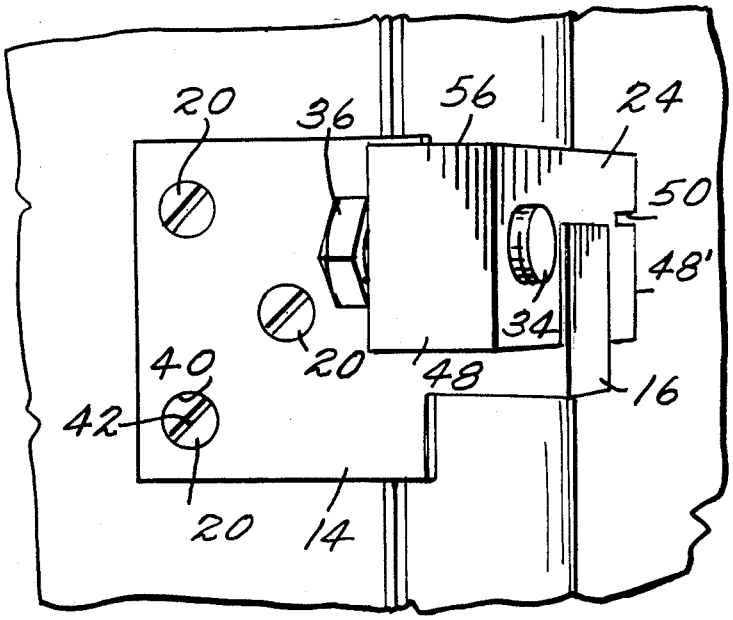
Fig. 7.
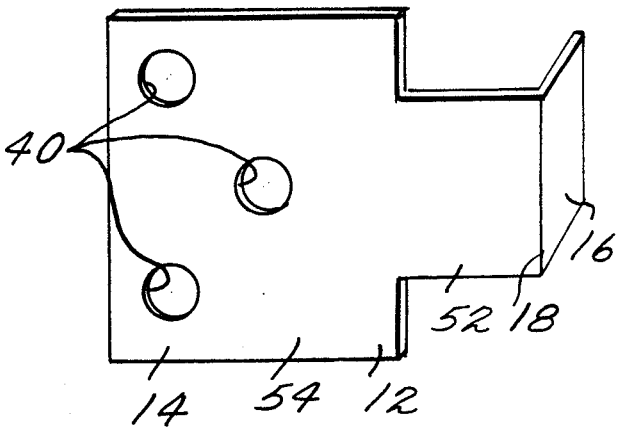
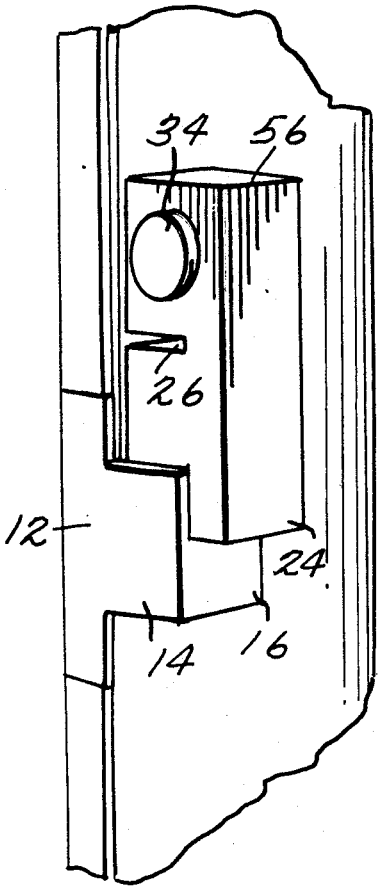
Fig. 6.

DOOR BAR

This invention relates to a door bar or stop and more particularly to a door bar which can be quickly and easily attached to door frames for fastening the door from the inside.

An object of the present invention is the provision of a door bar or fastener which can be quickly and easily installed.

Another object is to provide such a door bar which can be used on a left- or right-opening door.

A further object of the invention is the provision of such a door bar which can be adjusted to accomodate different sizes of door frames and moldings.

Yet another object of the present invention is the provision of such a door bar or stop which securely holds the door in a closed position without the need for a lock and key.

A still further object is to provide such a door bar which can be used for doors with either wood or metal frames.

Still another object is to provide such a door bar or fastener which provides much greater strength than chain locks or sliding bolt locks.

Another object is to provide such a door bar or stop which can be used in any room of a house where one wishes to have privacy.

Still another object is to provide such a door bar or fastener which can be installed and removed without leaving behind unsightly screw holes on the door and molding.

Another object is to provide such a door bar which can be used on doors without a door molding.

A further object of the invention is the provision of such a door bar or stop which includes an adjustable stop means or bolt-like member which enables the door bar to be mounted on virtually any door and molding combination.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects the present invention provides a door bar including a plate member defining a first substantially planar element of first predetermined thickness and a second substantially planar element of second predetermined thickness attached at substantially a right angle to the first element; means in operative relationship with the plate member for attaching the plate member to a door frame with the second element spaced apart from the door frame; and a bar member defining a first slot, the slot having a width greater than the first predetermined thickness for enabling the bar member to be removably mounted onto the plate member between the door-door frame and the second element.

More specifically, the door bar may further include stop means adjustably attached to the bar member for contacting the door when the bar member is positioned onto the plate member with the first slot receiving the first element and when the door is in a closed position with respect to the frame.

It is to be understood that both the foregoing general description and the following detailed description are exemplary and explanatory but are not restrictive of the invention.

The accompanying drawings which are incorporated in and constitute a part of this specification, illustrate an example of a preferred embodiment of the invention and, together with the description to explain the principles of the invention.

FIG. 3 is a fragmentary elevation view of the door bar in position with to the door-door frame;

FIG. 4 is a cross-sectional view taken along the line 4—4 in FIG. 3 and looking in the direction of the arrows;

FIG. 5 is a perspective view of the door bar with the door in an open position with respect to the door frame;

FIG. 6 is a perspective view of the door bar showing the bar member in the "parked" or stored position on the plate member; and FIG. 7 is a perspective view of the plate member.

Figure 1:
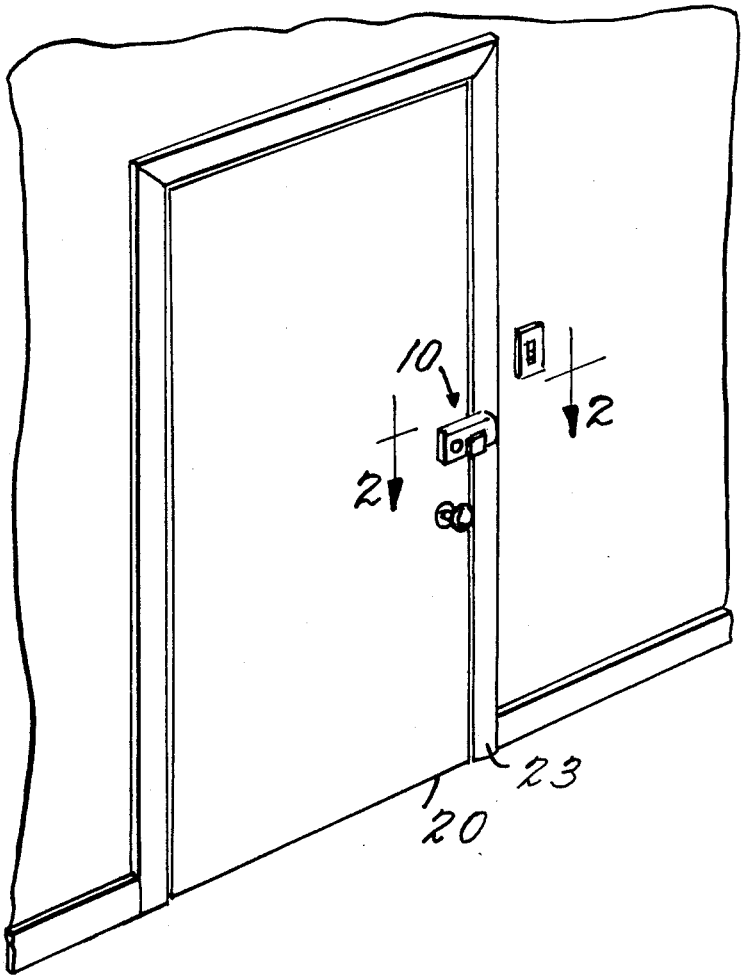
FIG. 1 is a perspective view of a door-door frame showing the door bar in position with the door in a closed position with respect to the door frame.
Figure 2:
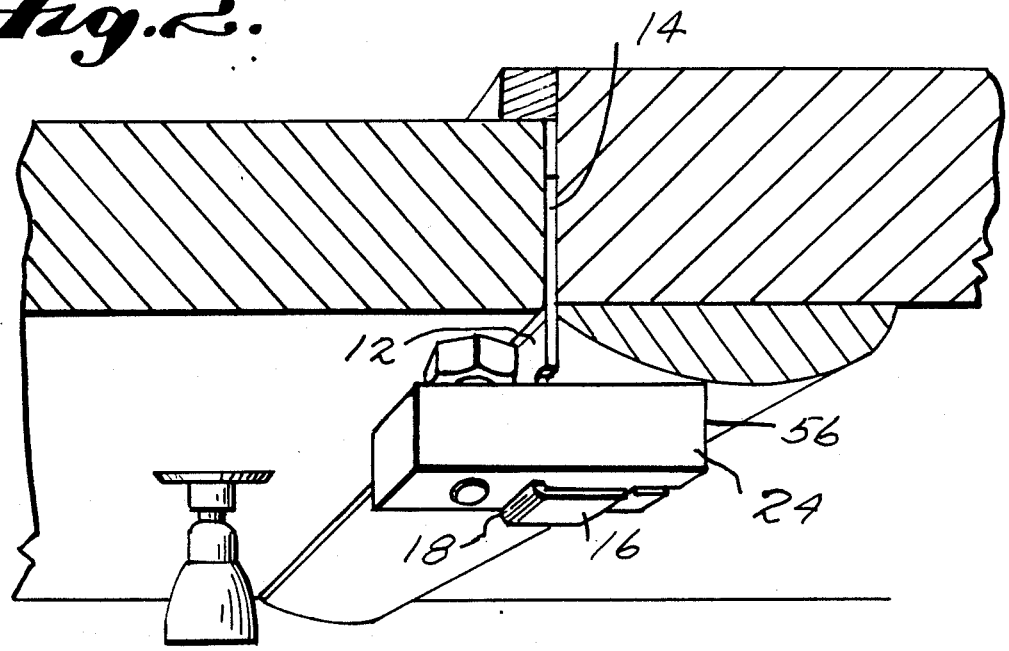
FIG. 2 is a cross-sectional perspective view taken along the line 2—2 in FIG. 1 and looking in the direction of the arrows.

With reference now to the drawings, wherein like reference characters designate like or corresponding parts throughout the several views, there is shown a door bar or stop 10 for use in combination with a door and a door frame-molding for maintaining the door in a closed position with respect to the frame. Door bar 10 includes a plate member 12 which defines a first substantially planar element 14 of a first predetermined thickness and a second substantially planar element 16 of a second predetermined thickness attached at substantially a right angle at location 18 to the first element 14.

In accordance with the invention, means 20, such as screws or other conventional fastening elements, are provided in operative relationship with plate member 12 for attaching the plate member to door frame 22 with second element 16 spaced apart from door frame 22.

A bar member 24 defines a first slot 26. Slot 26 has a width greater than the first predetermined thickness of first element 14 for enabling bar member 24 to be removably mounted onto plate element 12 and onto first element 14 between the door-door frame and second element 16.

Door bar 10 also includes stop means 28 adjustably attached to bar member 24 for contacting door 21 when bar member 24 is positioned onto plate member 12 with slot 26 receiving first element 14 and when door 21 is in a closed position with respect to frame 22.

In accordance with the invention, bar member 24 defines a threaded opening 30 therein, and stop means 28 includes a bolt-like member 32 defining a threaded shaft element 34 for threadably engaging opening 30. Bolt-like member 32 also includes a head element 36 attached to a first end 38 of shaft element 34 for contacting door 21 when the door is in a closed position with respect to frame 22. End element 36 can be configured as a conventional hexagonal bolthead.

First element 14 is partially positioned between door 21 and door frame 22 when plate member 12 is attached to frame 22. This is best illustrated in FIG. 4. First element 14 preferably defines a plurality of openings 40 therein and attaching means 20 preferably include a plurality of conventional screws 42 for extending into frame 22 through openings 40.

Threaded opening 30 preferably extends completely through bar member 24 for enabling a maximum range of adjustments of bolt-like member 32 with respect to bar member 24 and door 21 and for enabling door bar 10 to be used with left- or right-opening doors.

Further in accordance with the invention, bar member 24 defines first and second opposed and substantially parallel rectangular face surfaces 44, 44', third and fourth opposed and substantially parallel rectangular top and bottom surfaces 46, 46', and fifth and sixth opposed and substantially parallel rectangular end surfaces 48, 48'. First slot 26 is cut into bar member 24 from fourth or bottom surface 46', and first slot 26 extends completely through bar member 24 between the first and second face surfaces 44, 44'. Slot 26 is preferably located substantially mid-way between end surfaces 48, 48'.

Bar member 24 preferably further defines a second slot 50. Second slot 50 has a width greater than the thickness of second element 16. Slot 50 is positioned within bar member 24 for enabling the bar member to be removably mounted onto second element 16 between door frame 22 and element 16 to permit door 21 to open and to freely move past bar member 24. In accordance with the invention, second slot 50 is cut into bar member 24 from sixth or end surface 48', and slot 50 extends completely through bar member 24 between surfaces 44, 44'.

Preferably, threaded opening 40 extends between surfaces 44, 44', and opening 30 is located near one end of bar member 24 and adjacent to end surface 48.

Although it is not necessary for the proper functioning of the door bar, first element 14 may have a substantially T-shaped configuration, as best seen in FIG. 7. A narrowed portion 52 may extend from a wider portion 54 of element 14. In this configuration, second element 16 would have substantially the same vertical dimension as the vertical dimension of narrowed portion 52. This configuration will require less material and will provide for a smaller visible portion of bar 10. At the same time, wider portion 54 of element 14 will provide an appropriate area and a sufficient number of openings 40 to enable plate member 12 to be firmly attached to door frame 22.

In operation, thin plate member 12 is firmly attached to door frame 22 by a plurality of screws 42. Plate member 12 is attached to the door frame between the frame and door 21, as best illustrated in FIG. 4. Plate member 12 also is positioned with second element 16 spaced apart from door frame 22. If door bar 10 is to be used with a door not having a door molding, plate member 12 is attached to door frame 22 with second element 16 spaced apart from the inner surface 22' of door frame 22 by a distance only slightly greater than dimension 56 of bar member 24. If an attempt is then made to open door 21, it is stopped in its movement by contacting surface 44' of bar member 24. This, in turn, causes surface 44 of bar member 24 to contact second element 16 of plate member 12 so that inward movement of the door is prevented.

If door bar 10 is used with a door having a door molding 23, as shown in FIG. 4, plate member 12 is attached to door frame 22 with second element 16 spaced apart from molding 23 a sufficient distance to permit bar member 24 to be positioned between second element 16 and molding 23. In this use, bolt member 32 is threadably positioned within threaded opening 30 of bar member 24, and bar member 24 is positioned onto plate member 12 by means of slot 26, as previously described. Bolt-like member 32 can be adjusted within opening 30 so that head element 36 contacts inner surface 21' of door 21 at the same time that surface 44 of bar member 24 contacts second element 16. When pressure is then exerted to open the door inwardly against stop means 28, the attempted inward movement of the door will force surface 44 of bar member 24 against second element 16, and further movement of the door will be prevented. If plate member 12 is attached to the door frame so that second element 16 is spaced apart from molding 23 so that bar member 24 almost simultaneously contacts molding 23 and second element 16 when stop means 28 contacts door 21, very little movement of bar member 24 will occur when one tries to open the door. As a result, any advantage which would be gained by inertial movement of the door is lost when someone tries to force the door open by bumping into it. Even if bar member 24 only contacts molding 23 and does not contact second element 16, if stop means 28 contacts inner surface 21' of door 21, the door will still be firmly held in place.

When door bar 10 is not in use, bar member 24 can be parked or stored on plate member 12 by sliding second element 16 into slot 50 of bar member 24. This enables the bar member to be stored in a convenient and readily accessible location while still permitting the door to freely open and close. This position of bar member 24 in the parked position is illustrated in FIG. 6.

The configuration of door bar 10 enables the bar to be used with left- and right-opening doors by simply flipping it over and repositioning bolt-like member 32 within threaded opening 30.

The invention in its broader aspects is not limited to the specific details shown and described, and departures may be made from such details without departing from the principles of the invention and without sacrificing its chief advantages.

What is claimed is:

1. A door bar for use in combination with a door and a door frame for maintaining the door in a closed position with respect to the frame, said door bar comprising: 'a plate member defining a first substantially planar element of first predetermined thickness and a second substantially planar element of second predetermined thickness attached at substantially a right angle to said first element, said first planar element partially positioned between said door and said frame when said plate member is attached to said frame;

said first planar element defining a plurality of openings therein and means in operative relationship with said plate member, including a plurality of screws for extending into said frame through said openings, for attaching said plate member to said door frame with said second element spaced apart from said door frame;

a bar member defining first and second opposed and substantially parallel rectangular face surfaces, third and fourth opposed and substantially parallel rectangular top and bottom surfaces, fifth and sixth opposed and substantially parallel rectangular end surfaces, and a first slot, said slot having a width greater than said first predetermined thickness for enabling said bar member to be removably mounted onto said plate member between said door-door frame and said second element;

said first slot cut into said bar member from said fourth or bottom surface and said first slot extending completely through said bar member between said first and second face surfaces;

stop means adjustably attached to said bar member for contacting said door when said bar member is positioned onto said plate member with said first slot receiving said first element and when said door is in a closed position with respect to said frame; and said bar member further defining a threaded opening extending completely through said bar member and wherein said stop means includes a bolt-like member comprising a threaded shaft element for threadably engaging said opening and a head element attached to a first end of said shaft element for contacting said door when said door is in a closed position with respect to said frame.

2. A door bar as in claim 1 wherein said first slot is located substantially mid-way between said fifth and sixth end surfaces.

3. A door bar for use in combination with a door and a door frame for maintaining the door in a closed position with respect to the frame, said door bar comprising:

a plate member defining a first substantially planar element of first predetermined thickness and a second substantially planar element of second predetermined thickness attached at substantially a right angle to said first element;

means in operative relationship with said plate member for attaching said plate member to said door frame with said second element spaced apart from said door frame;

a bar member defining a first slot, said slot having a width greater than said first predetermined thickness for enabling said bar member to be removably mounted onto said plate member between said door-door frame and said second element; and said bar member further defining a second slot, said second slot having a width greater than said second predetermined thickness and positioned within said bar member for enabling said bar member to be removably mounted onto said second element between said door frame and said second element for enabling the door to open and to freely move past said bar member.

4. A door bar as in claim 3 wherein said bar member defines first and second opposed and substantially parallel rectangular face surfaces, third and fourth opposed and substantially parallel rectangular top and bottom surfaces and fifth and sixth opposed and substantially parallel end surfaces.

5. A door bar as in claim 4 wherein said second slot is cut into said bar member from said sixth or end surface and wherein said second slot extends completely through said bar member between said first and second face surfaces.

6. A door bar as in claim 5 wherein said threaded opening extends between said first and second face surfaces.

7. A door bar as in claim 6 wherein said threaded opening is located near one end of said bar member adjacent to said fifth or end surface.

* * * * *